US012584683B2

(12) United States Patent
Hwang et al.

(10) Patent No.: US 12,584,683 B2
(45) Date of Patent: Mar. 24, 2026

(54) REFRIGERATOR

(71) Applicant: SAMSUNG ELECTRONICS CO., LTD., Suwon-si (KR)

(72) Inventors: Inyong Hwang, Suwon-si (KR); Wonho Jang, Suwon-si (KR); Myoungjin Jang, Suwon-si (KR); Seyeun Chang, Suwon-si (KR); Yongman Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 89 days.

(21) Appl. No.: 18/385,211

(22) Filed: Oct. 30, 2023

(65) Prior Publication Data

US 2024/0060710 A1 Feb. 22, 2024

Related U.S. Application Data

(63) Continuation of application No. PCT/KR2022/009318, filed on Jun. 29, 2022.

(30) Foreign Application Priority Data

Jul. 19, 2021 (KR) ..... 10-2021-0094276

(51) Int. Cl.
*F25D 23/06* (2006.01)
*F25D 25/02* (2006.01)

(52) U.S. Cl.
CPC ..... *F25D 23/067* (2013.01); *F25D 25/025* (2013.01); *A47B 2210/175* (2013.01); *F25D 2323/122* (2013.01)

(58) Field of Classification Search
CPC ..... F25D 23/067; F25D 25/025; F25D 2323/122; A47B 2210/175
See application file for complete search history.

(56) References Cited

U.S. PATENT DOCUMENTS 7,712,852 B2 5/2010 Choi et al.
10,215,474 B2 2/2019 Lim et al.
(Continued)

FOREIGN PATENT DOCUMENTS

CN 207622339 U 7/2018
CN 208296428 U 12/2018
(Continued)

OTHER PUBLICATIONS

Translation JP6530271B2 (Year: 2019).*
(Continued)

*Primary Examiner* — Andrew Roersma
(74) *Attorney, Agent, or Firm* — Sughrue Mion, PLLC

(57) ABSTRACT

A refrigerator includes an inner case forming a storage compartment therein, the inner case including an inner wall surrounding the storage compartment; an outer case coupled to an outer side of the inner case; a foamed insulation material disposed between the inner case and the outer case; a storage container configured to be slidably inserted into and withdrawn from the storage compartment; a rail unit disposed inside the storage compartment, the rail unit being configured to guide a movement of the storage container, the rail unit including a coupling protrusion that is coupled to the inner wall; an insertion groove formed on the inner wall to allow the coupling protrusion to insert therein; and a coupling groove formed on the inner wall so that the rail unit coupled to the insertion groove fixes to the inner wall.

14 Claims, 19 Drawing Sheets

(56) References Cited

U.S. PATENT DOCUMENTS

| | | | | |
|---|---|---|---|---|
| 10,563,912 | B1 * | 2/2020 | Kumar | A47B 88/487 |
| 2003/0173882 | A1 * | 9/2003 | Koons | A47B 88/43 312/334.7 |
| 2006/0232177 | A1 * | 10/2006 | Filho | F16B 12/26 312/407 |
| 2007/0084234 | A1 | 4/2007 | Park et al. | |
| 2007/0085457 | A1 | 4/2007 | Park et al. | |
| 2007/0210089 | A1 * | 9/2007 | Kauk | B29C 44/16 220/592.1 |
| 2010/0066228 | A1 * | 3/2010 | Park | F25D 23/067 312/408 |
| 2014/0230481 | A1 * | 8/2014 | Yun | B67D 1/0014 62/340 |
| 2017/0160002 | A1 * | 6/2017 | Kang | F25D 25/025 |
| 2018/0149416 | A1 * | 5/2018 | Lee | B01D 35/30 |
| 2018/0313601 | A1 * | 11/2018 | Sert | F25D 25/025 |
| 2022/0034581 | A1 * | 2/2022 | You | F25D 23/006 |
| 2023/0175763 | A1 * | 6/2023 | Ma | F25D 23/126 312/404 |

FOREIGN PATENT DOCUMENTS

| | | | | | |
|---|---|---|---|---|---|
| CN | 109990558 | A | * | 7/2019 | |
| CN | 106338177 | B | | 8/2020 | |
| DE | 102012012168 | A1 | * | 11/2013 | F25D 23/067 |
| DE | 102016224143 | A1 | * | 6/2018 | |
| EP | 3163233 | A1 | * | 5/2017 | F25D 23/067 |
| JP | 5-27588 | U | | 4/1993 | |
| JP | 8-178518 | A | | 7/1996 | |
| JP | 2522096 | Y2 | | 1/1997 | |
| JP | 2816083 | B2 | | 10/1998 | |
| JP | 2006-78168 | A | | 3/2006 | |
| JP | 6530271 | B2 | | 6/2019 | |
| KR | 200339270 | Y1 | * | 1/2004 | |
| KR | 10-2007-0042059 | A | | 4/2007 | |
| KR | 10-0714971 | B1 | | 5/2007 | |
| KR | 1020070113414 | A | * | 11/2007 | |
| KR | 101343093 | B1 | * | 12/2013 | |
| KR | 10-2014-0000100 | A | | 1/2014 | |
| KR | 10-2015-0003633 | A | | 1/2015 | |
| KR | 10-2017-0081487 | A | | 7/2017 | |
| WO | WO-2015188862 | A1 | * | 12/2015 | F25D 23/067 |
| WO | WO-2016066214 | A1 | * | 5/2016 | F25D 23/067 |

OTHER PUBLICATIONS

Translation JPH08178518A (Year: 1996).*

Translation KR20150003633A (Year: 2015).*

International Search Report (PCT/ISA/210) dated Oct. 18, 2022, issued by International Searching Authority for International Application No. PCT/KR2022/009318.

Communication issued on Aug. 20, 2024 by the European Patent Office for European Patent Application No. 22846073.9.

Communication issued on Oct. 28, 2025 by the European Patent Office in European Patent Application No. 22846073.9.

* cited by examiner

REFRIGERATOR

CROSS-REFERENCE TO RELATED APPLICATION

This application is a continuation of PCT/KR2022/009318, filed on Jun. 29, 2022, at the Korean Intellectual Property Receiving Office and claims priority under 35 U.S.C. § 119 to Korean Patent Application No. 10-2021-0094276, filed on Jul. 19, 2021 at the Korean Intellectual Property Office, the disclosures of each which are incorporated by reference herein in their entireties.

TECHNICAL FIELD

The technical field relates to a refrigerator, and more specifically, to a combined structure between a rail for guiding a movement of a storage container and an inner case.

BACKGROUND

A refrigerator is an apparatus that may include a main body having a storage compartment and a cold air supply system for supplying cold air to the storage compartment, thereby keeping food fresh.

The storage compartment may be provided with a storage container that may be inserted and withdrawn in a slide manner. For this purpose, a rail unit may be provided in the storage compartment to guide the movement of the storage container.

In conventional refrigerators, guide parts may be provided on upper ends of opposite side walls of the storage container, and a rail unit is installed on at least one side surface of the storage compartment to support this guide parts. In addition, a support member is installed on a bottom wall of the inner case to support the storage container, and the rail unit may be coupled to the support member. A passing hole may be formed on the bottom wall of the inner case for installation of the support member, and when an insulation material is injected into an outer side of the inner case, a foaming liquid may leak through the passing hole formed on the inner case.

SUMMARY

The disclosed embodiments are directed to providing a refrigerator in which a bottom wall, side walls, and rail units of an inner case are combined without separate support members.

The disclosed embodiments are directed to providing a refrigerator in which a rail unit fixing structure formed on a bottom wall of an inner case does not interfere with other components (e.g., storage containers disposed adjacent to a bottom of a storage compartment) disposed in a storage compartment even when a rail unit is not mounted on the bottom wall of the inner case.

A refrigerator may include an inner case forming a storage compartment therein, the inner case including an inner wall surrounding the storage compartment; an outer case coupled to an outer side of the inner case; a foamed insulation material disposed between the inner case and the outer case; a storage container configured to be slidably inserted into and withdrawn from the storage compartment; a rail unit disposed inside the storage compartment, the rail unit being configured to guide a movement of the storage container, the rail unit including a coupling protrusion that is coupled to the inner wall; an insertion groove formed on the inner wall to allow the coupling protrusion to insert therein; and a coupling groove formed on the inner wall so that the rail unit coupled to the insertion groove fixes to the inner wall.

The inner wall of the inner case may include a bottom wall forming a bottom of the storage compartment. The insertion groove may be formed on the bottom wall so that the coupling protrusion inserts into the insertion groove in a front to rear direction.

The inner wall of the inner case may include opposite side walls disposed on opposite sides of the storage compartment. The insertion groove may be formed on each of the side walls so that the coupling protrusion inserts into the insertion groove in a front to rear direction.

The bottom wall may include a bottom surface forming the bottom of the storage compartment, and a back surface that is opposite to the bottom surface. The insertion groove may include an opening formed on the bottom surface to allow the coupling protrusion to insert therein, an inclined portion inclined downward from the bottom surface toward a rear of the insertion groove to support the coupling protrusion, and a locking portion positioned to restrain an upper surface of the coupling protrusion to connect to the inclined portion.

The insertion groove may further include a rounded portion connecting the inclined portion and the locking portion.

The bottom wall may further include an embossed portion that protrudes upward from the bottom surface so that a receiving space is formed on the back surface. At least a portion of the inclined portion and at least a portion of the coupling portion may be disposed in the receiving space.

The coupling groove may be disposed on a front side of the insertion groove. The rail unit may further include a fixing part that corresponds to the coupling groove, the fixing part being fixed to the coupling groove.

The fixing part may be screwed into the coupling groove.

The coupling groove comprises a recess and a fastening protrusion that protrudes upward from a bottom surface of the recess.

The rail unit may further include a rail bottom configured to support a guide part of the storage container. The fixing part may include a side wall extending downward from the rail bottom to form a recessed space and having a lower end that inserts in the recess, and a bottom positioned to face the fastening protrusion, the bottom having a hole to allow a screw to pass therethrough.

The coupling groove may include an opening configured to allow the fixing part to be inserted therein, a receiving space configured to receive the fixing part inserted through the opening, and a locking jaw on which the fixing part is caught.

The fixing part may include an inclined surface configured to be inserted through the opening, and a bi-directional protrusion protruding to be caught on the locking j aw.

The rail unit may further include a connection protrusion that protrudes downward from the rail bottom and is configured to be connected to the coupling protrusion.

The rail unit may further include a guide wall extending upward from the bottom rail, the guide wall being configured to guide the outside of the guide part of the storage container. A water tank unit may be disposed between the guide wall and one side wall of the inner case.

The water tank unit may include a casing that is fixed to the guide wall, and a water tank that is accommodated inside the casing.

A refrigerator may include an inner case forming a storage compartment therein, the inner case including an inner wall surrounding the storage compartment; an outer case coupled to an outer side of the inner case; a foamed insulation material disposed between the inner case and the outer case; a storage container configured to be slidably inserted into and withdrawn from the storage compartment; a rail unit disposed inside the storage compartment; a coupling protrusion provided on one of the inner wall or the rail unit; an insertion groove formed on an other of the inner wall or the rail unit so that the coupling protrusion inserts therein; and a coupling groove formed on the inner wall so that the rail unit is fixed to the inner wall.

The inner wall of the inner case may include a bottom wall forming a bottom of the storage compartment. The bottom wall may include a bottom surface forming the bottom of the storage compartment, and an embossed portion that protrudes upward from the bottom surface. The coupling protrusion may be disposed on the rail unit. The insertion groove may be disposed on the embossed portion. The insertion groove may include an opening formed on the bottom surface so that the coupling protrusion inserts therein, an inclined portion inclined downward from the bottom surface toward a rear of the insertion groove, and a locking portion positioned to restrain the coupling protrusion to connect to the inclined portion.

The inner wall of the inner case may include a bottom wall forming a bottom of the storage compartment. The bottom wall may include a bottom surface forming the bottom of the storage compartment, and a recessed portion that recesses downward from the bottom surface. The coupling protrusion may be disposed on the recessed portion. The insertion groove may be disposed on the rail unit.

The inner wall of the inner case may include opposite side walls disposed on opposite sides of the storage compartment. The side walls of the inner case may include side surfaces forming opposite sides of the storage compartment, and embossed portions that protrude from the side surfaces toward the storage compartment. The coupling protrusion may be disposed on the rail unit. The insertion groove may be disposed on the embossed portion. The insertion groove may include: an opening formed on the side surface to allow the coupling protrusion to insert therein, an inclined portion inclined downward from the side surface toward a rear of the insertion groove, and a locking portion positioned to restrain the coupling protrusion to connect to the inclined portion.

The coupling groove may be disposed on a front side of the insertion groove. The rail unit may include a fixing part that corresponds to the coupling groove, the fixing part being fixed to the coupling groove.

Tail units guiding a storage container can be fixed to a bottom wall and side walls of an inner case even without separate support members.

In addition, even when there is no rail unit coupled to the bottom wall of the inner case, the storage container and a fixing structure formed on the bottom wall of the inner case do not interfere, so that the storage container can be smoothly inserted or withdrawn.

DETAILED DESCRIPTION

Figure 1:
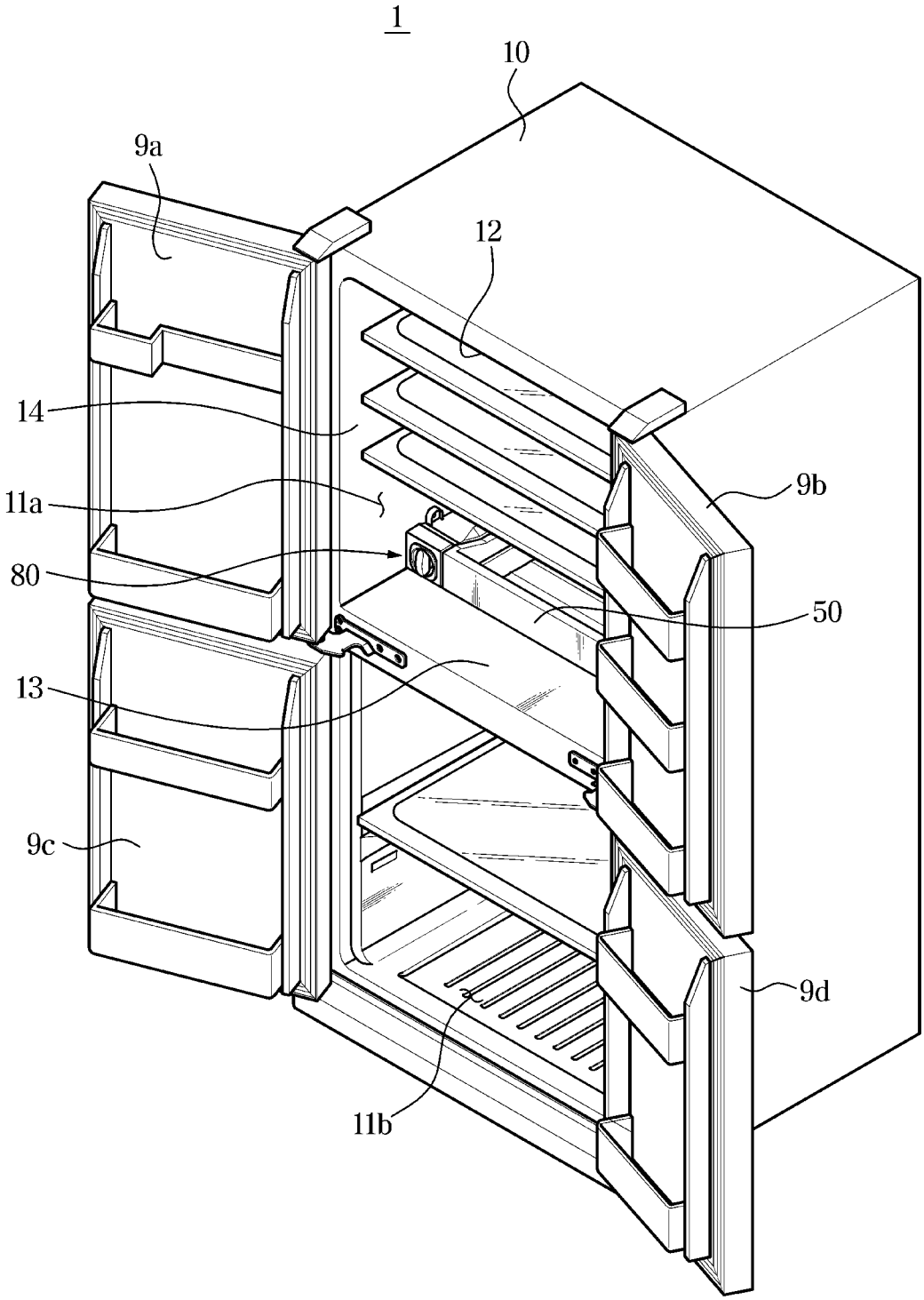
FIG. 1 is a perspective view of a refrigerator according to an embodiment of the present disclosure.

The embodiments described in the present specification and the configurations shown in the drawings are only examples of preferred embodiments, and various modifications may be made to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the disclosed embodiments. For example, the singular expressions herein may include plural expressions, unless the context clearly dictates otherwise. Also, the terms "comprises" and "has" are intended to indicate that there are features, numbers, steps, operations, components, parts, or combinations thereof described in the specification, and do not exclude the presence or addition of one or more other features, numbers, steps, operations, components, parts, or combinations thereof.

It will be understood that, although the terms first, second, etc. may be used herein to describe various components, these components should not be limited by these terms, and the terms are only used to distinguish one component from another. For example, without departing from the scope of the disclosed embodiments, a first component may be referred to as a second component, and similarly, the second component may also be referred to as a first component. The term "and/or" includes any combination of a plurality of related items or any one of a plurality of related items.

In this specification, the terms "front," "rear," "left," and "right," used in the following description are defined with reference to the drawings, and the shape and position of each component are not limited by these terms.

Hereinafter, embodiments will be described in detail with reference to the accompanying drawings.

Figure 2:
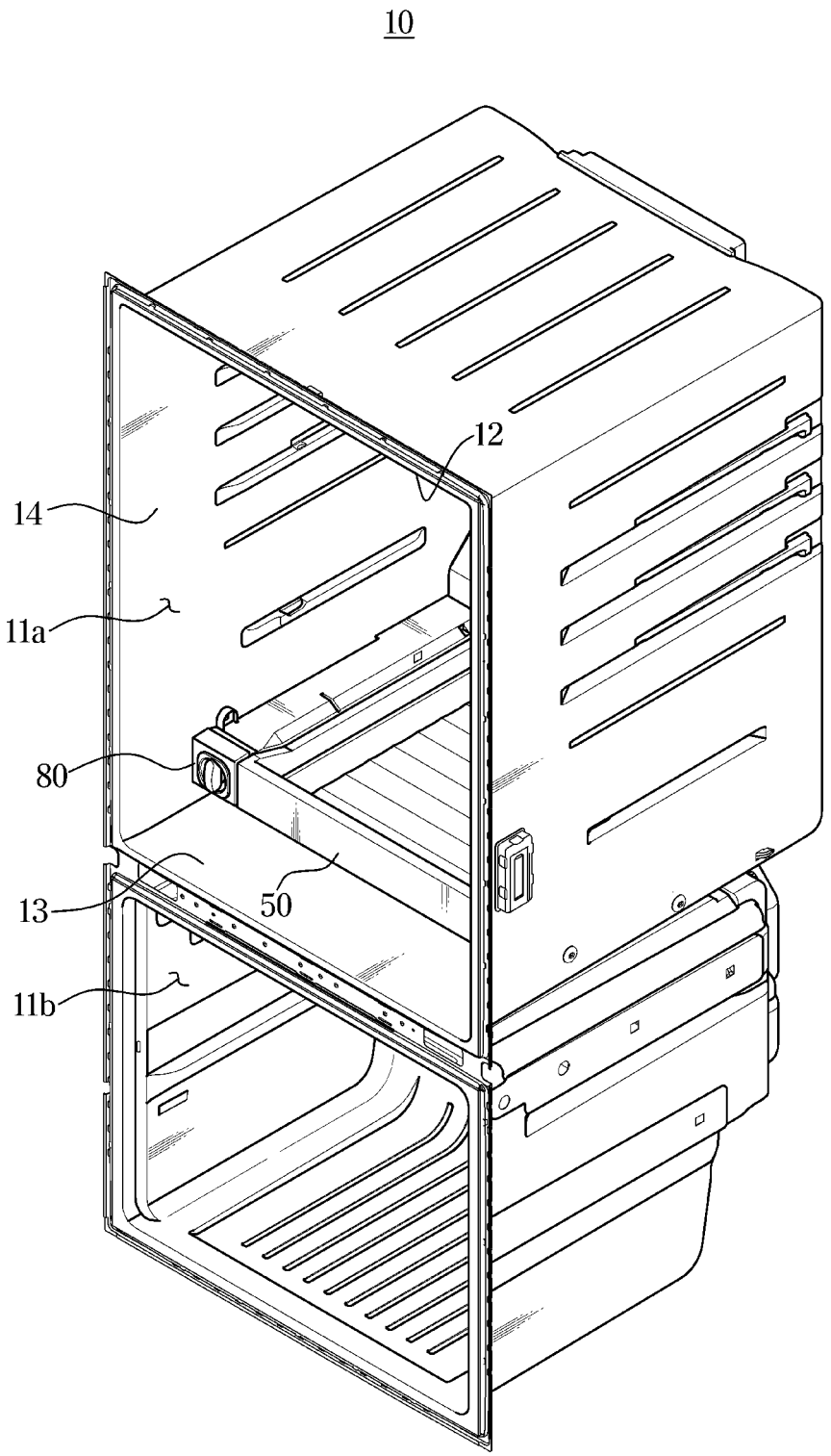
FIG. 2 is a perspective view illustrating an inner case and storage compartments in the refrigerator according to an embodiment of the present disclosure.
Figure 3:
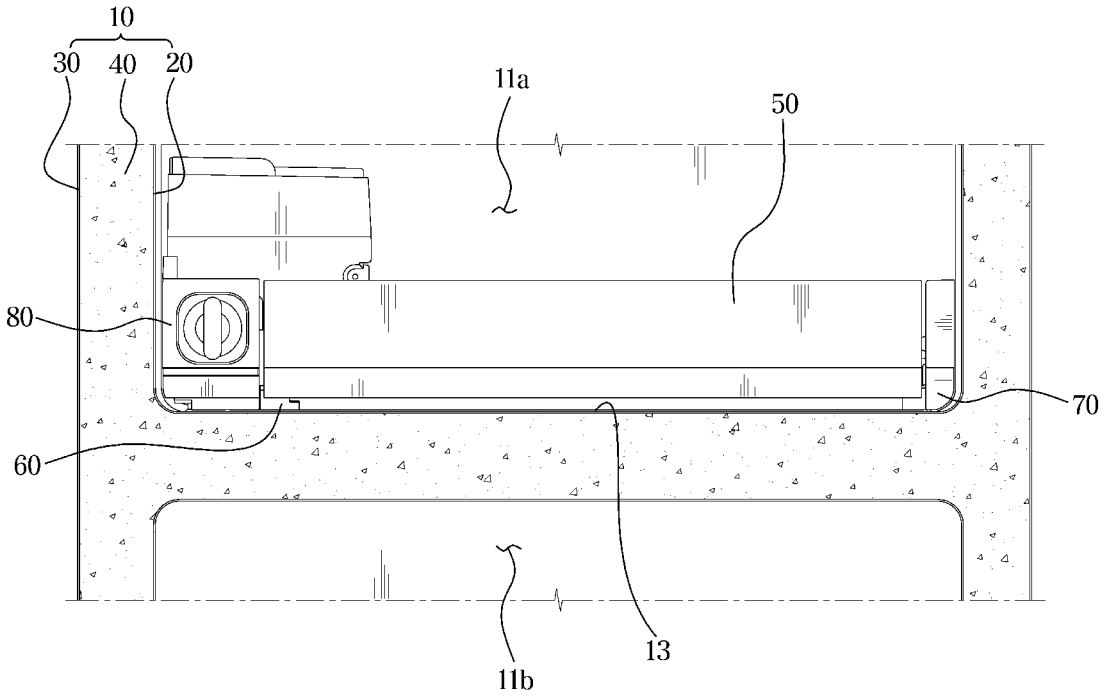
FIG. 3 is an enlarged view of a part of the structure in FIG. 1.

Referring to FIGS. 1 to 3, a refrigerator 1 may include a main body 10, storage compartments 11*a* and 11*b* formed inside the main body 10 to store food, and a cold air supply system (not shown) provided to supply cold air to the storage compartments 11*a* and 11*b*. The refrigerator 1 may include doors 9*a* to 9*d* provided to open and close the storage compartments 11*a* and 11*b*.

The storage compartments 11*a* and 11*b* may be partitioned into the upper refrigerating compartment 11*a* provided to store food in a refrigerated state and the lower freezing compartment 11*b* provided to store food in a frozen state. The refrigerating compartment 11*a* may store food in the refrigerated state by maintaining a temperature at about 0 to 5 degrees Celsius. The freezing compartment 11*b* may store food in the frozen state by maintaining a temperature at about 0 to minus 30 degrees Celsius.

However, this storage compartment structure is only an example, and the disclosed embodiments are not limited to the storage compartment structure.

The cold air supply system may generate cold air using a refrigeration cycle. The cold air supply system may include a compressor (not shown), a condenser (not shown), an expansion device (not shown), an evaporator (not shown), a blowing fan (not shown), and at least one refrigerant circuit in which a refrigerant circulates.

The main body 10 may be provided in a substantially box shape with an open front. The main body 10 includes an inner case 20, an outer case 30 coupled to the outside of the inner case 20, and a foamed insulation material 40 formed by foaming between the inner case 20 and the outer case 30 (see FIG. 3).

The inner case 20 may be formed by injection molding of a resin material. The inner case 20 may form the storage compartments 11*a* and 11*b* therein. That is, the inner case 20 may define a range of each of the storage compartments 11*a* and 11*b*.

Figure 6:
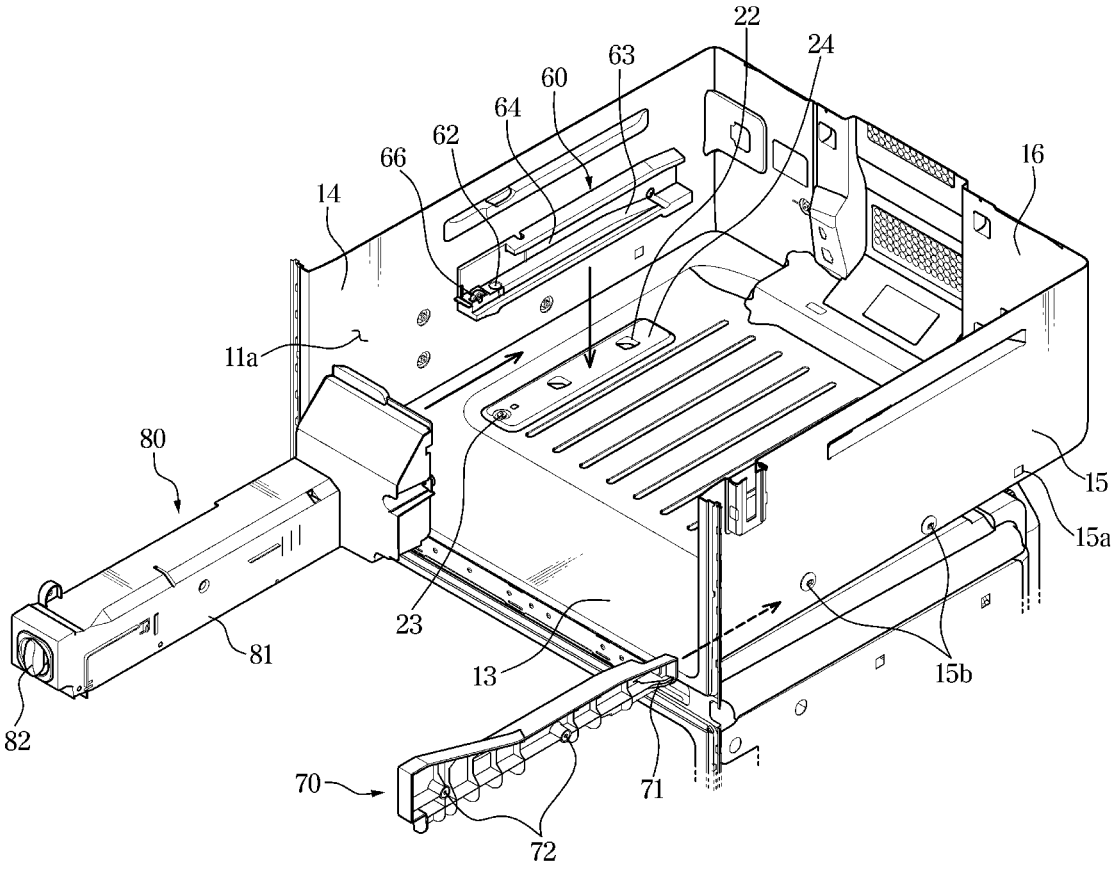
FIG. 6 is a perspective view illustrating that the rail unit, the side rail unit, and a water tank unit illustrated in FIG. 3 are separated from the inner case.
Figure 7:
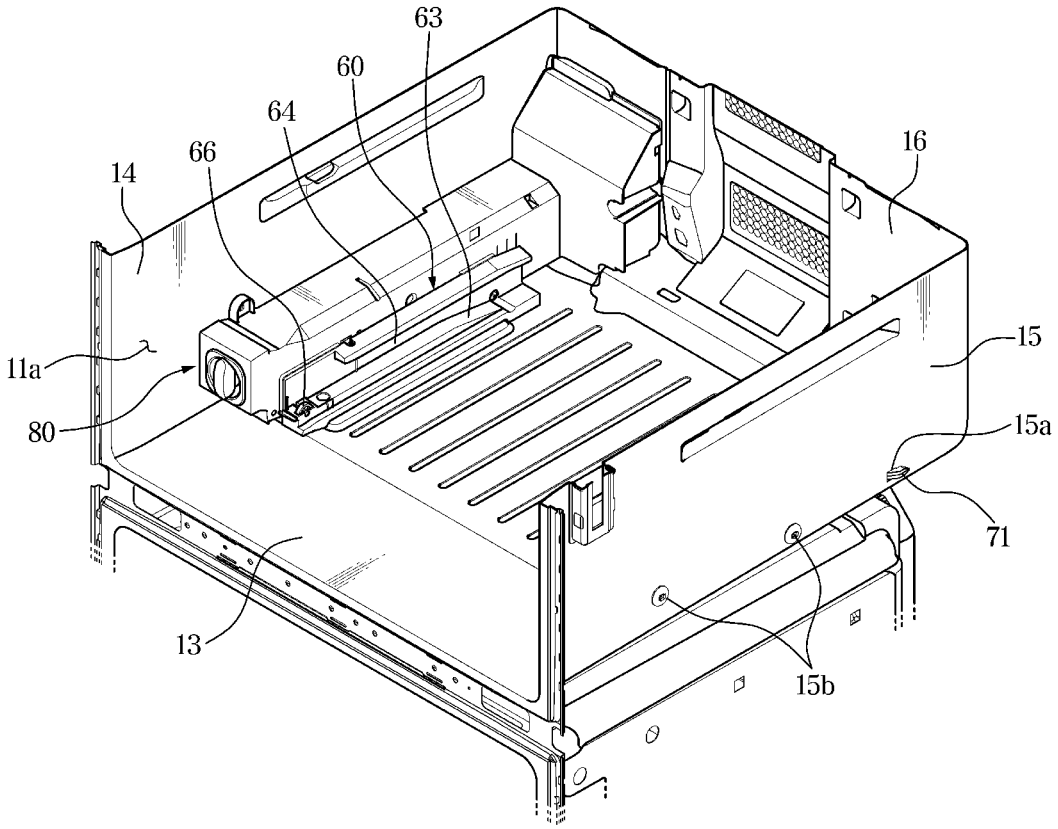
FIG. 7 is a view illustrating a state in which the rail unit, the side rail unit, and the water tank unit illustrated in FIG. 3 are coupled to the inner case.

Based on the upper refrigerating compartment 11*a*, an inner wall of the inner case 20 may include an upper wall 12, a bottom wall 13, a left wall 14, a right wall 15, and a rear wall 16, which surround the refrigerating compartment 11*a* (see FIGS. 2, 6, and 7).

Based on the lower freezing compartment 11*b*, the inner wall of the inner case 20 may include an upper wall, a bottom wall, a left wall, a right wall, and a rear wall, which surround the freezing compartment 11*b* (see FIG. 2).

The outer case 30 may be made of metal and may form an exterior.

The foamed insulation material 40 may be provided between the inner case 20 and the outer case 30. The foamed insulation material 40 includes foamed urethane mixed with urethane and a blowing agent. The foamed insulation material 40 may be filled and foamed between the inner case 20 and the outer case 30 after the inner case 20 and the outer case 30 are combined.

The foamed insulation material 40 may have a strong adhesion force to reinforce a bonding force between the inner case 20 and the outer case 30, and may have a sufficient strength when the foaming is completed. In addition, the foamed insulation material 40 may fix a side rail unit 70 to a right wall 15 of the inner case 20. As necessary, a vacuum insulation material (vacuum insulation panel) may be added between the inner case 20 and the outer case 30 in addition to the foamed insulation material 40.

A storage container 50 capable of storing food may be provided inside the storage compartments 11*a* and 11*b*. The storage container 50 may be inserted into and withdrawn from the storage compartments 11*a* and 11*b* using the slide manner. A plurality of the storage containers 50 may be disposed.

Figure 4:
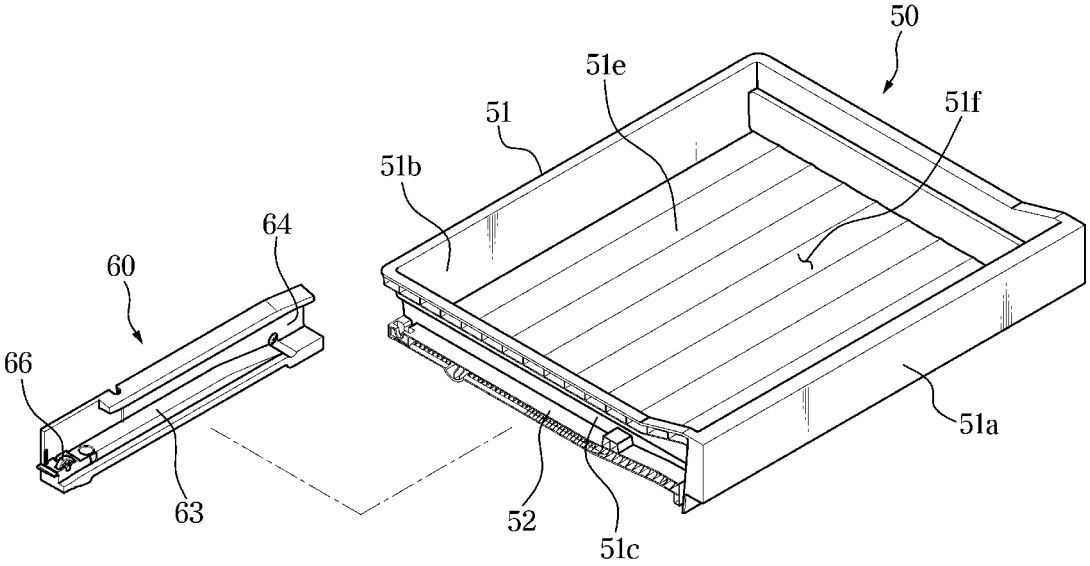
FIG. 4 is a perspective view illustrating that a storage container and a rail unit illustrated in FIG. 3 are separated.
Figure 5:
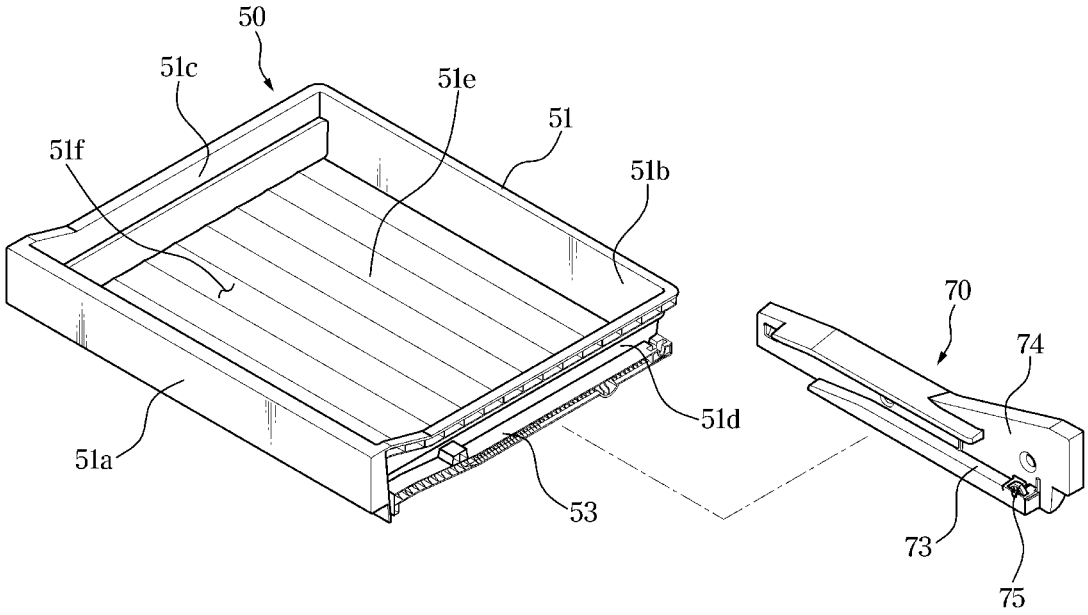
FIG. 5 is a view illustrating that the storage container and a side rail unit illustrated in FIG. 3 are separated.

As illustrated in FIGS. 4 and 5, the storage container 50 may include a body 51 having a storage space 51*f* and guide parts 52 and 53 provided on opposite sides of the body 51.

The body 51 may include a front wall 51*a*, a rear wall 51*b*, a left wall 51*c*, a right wall 51*d*, and a bottom wall 51*e*. Therefore, an upper side of the storage container 51 may be open. Food may be put in and taken out of the storage space 51*f* through the open upper side. However, unlike this embodiment, the storage container 50 may include a cover (not shown) coupled to the body 51 to open and close the open upper side and may store food in an airtight manner.

As illustrated in FIG. 4, the body 51 of the storage container 50 may include the first guide part 52 protruding from a lower end of the left wall 51*c* and extending long in a front-rear direction. The first guide part 52 is received by being in contact with a rail bottom 63 and a guide wall 64. A lower surface of the first guide part 52 may be supported by a rail roller 66 of the rail unit 60.

The first guide part 52 may include a guide roller (not shown) provided at the rear of the first guide part 52. The guide roller may roll on the rail bottom 63.

As illustrated in FIG. 5, the body 51 of the storage container 50 may include the second guide part 53 protruding from a lower end of the right wall 51*d* and extending long in the front-rear direction. The second guide part 53 is received by being in contact with a bottom 73 and a guide wall 74 of the side rail unit. A lower surface of the second guide part 53 may be supported by a rail roller 75 of the side rail unit 70.

Like the first guide part 52, the second guide part 53 may include a guide roller (not shown) provided at the rear of the second guide part 53. The guide roller may roll on the bottom 73 of the side rail unit.

By the interaction of the guide parts 52 and 53, rail unit 60 and side rail unit 70, the storage container 50 may smoothly slide in the front-rear direction to be inserted into and withdrawn from the storage compartments 11*a* and 11*b*.

However, the structures of the storage container 50, rail unit 60 and side rail unit 70 are only an example, and the disclosed embodiments are not limited to the structures of the storage container 50, rail unit 60 and side rail unit 70 illustrated in FIGS. 4 and 5.

As illustrated in FIGS. 1, 6 and 7, the refrigerator 1 may include the rail units 60 and side rail units 70 provided inside the storage compartments 11*a* and 11*b* to support the storage container 50 and guide a movement of the storage container 50.

The refrigerator 1 may include a water tank unit 80 disposed on the left side of the storage container 50 to supply water through a dispenser (not shown) provided on the door 9*a*.

The storage container 50 may be supported by the rail unit 60 and the side rail unit 70. However, pluralities of the storage containers 50, rail units 60, and side rail units 70 may be provided.

The rail unit 60 may be coupled to the inner wall of the inner case 20. For this purpose, an insertion groove and a coupling groove are formed on the inner wall of the inner case 20, and the rail unit 60 may include a coupling protrusion inserted into the insertion groove and a fixing part fixed to the coupling groove.

The rail unit 60 may be coupled to the bottom wall 13 of the inner case 20. For this purpose, an insertion groove 22 and a coupling groove 23 are formed on the bottom wall 13 of the inner case 20, and the rail unit 60 includes a coupling protrusion 61 (see FIG. 9) inserted into the insertion groove 22 and a fixing part 62 (see FIG. 9) fixed to the coupling groove 23. Specifically, the insertion groove 22 and the coupling groove 23 may be formed on a bottom surface 13*a* of the bottom wall 13 (see FIG. 8).

A plurality of the insertion grooves 22 may be provided, and a plurality of the coupling protrusions 61 may also be provided to correspond to the insertion grooves 22. As the coupling protrusion 61 is inserted into the insertion groove 22 in the front-rear direction and then the fixing part 62 and the coupling groove 23 are screwed together, the rail unit 60 may be fixed to the bottom wall 13 of the inner case 20.

The rail unit 60 also may include the bottom 63 and the guide wall 64. The rail unit 60 may be coupled to the water tank unit 80 in contact with the rail unit 60 through the guide wall 64.

The side rail unit 70 may be coupled to the right wall 15 of the storage compartment 11*a*. For this purpose, a hole 15*a* and a groove 15*b* may be formed on the right wall 15. The side rail unit 70 may include a protrusion 71 passing through the hole 15*a* and a threaded part 72 fixed to the groove 15*b*.

A plurality of the grooves 15*b* may be provided, and a plurality of the threaded parts 72 may also be provided to correspond to the grooves 15*b*.

The water tank unit 80 may be coupled to a left wall 14 of the inner case 20. One side surface of the water tank unit 80 may be coupled through the guide wall 64 of the rail unit 60. The water tank unit 80 may include a casing 81 fixed to the guide wall 64 and a water tank 82 accommodated inside the casing 81 to store water.

The rail unit 60 and bottom wall 13 of the refrigerator 1 will be described below with reference to FIGS. 1 and 8 to 10.

The rail unit 60 may be installed on the bottom wall 13 of the inner case 20.

Figure 8:
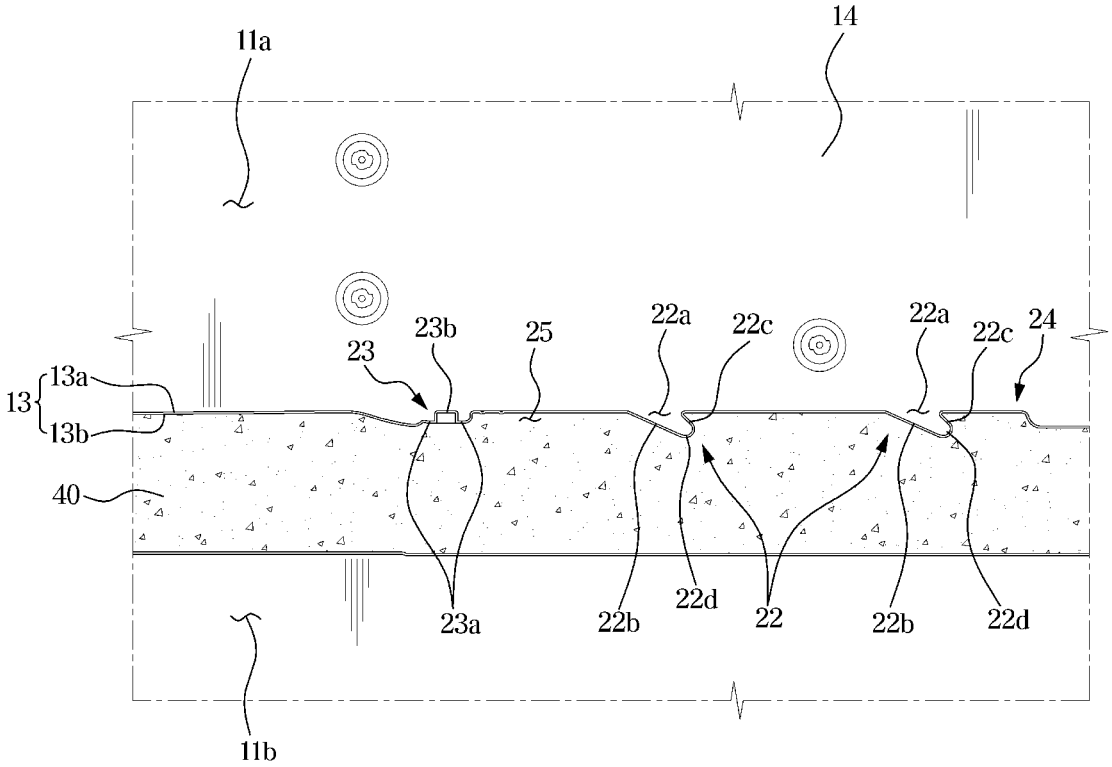
FIG. 8 is an enlarged view of a bottom wall of the inner case in the refrigerator according to an embodiment of the present disclosure.

As illustrated in FIG. 8, the bottom wall 13 of the inner case 20 includes the bottom surface 13*a* forming the bottom of the refrigerating compartment 11*a* and a back surface 13*b* on the opposite side of the bottom surface 13*a*. The back surface 13*b* of the bottom wall 13 may be in contact with the foamed insulation material 40.

The bottom wall 13 may include the insertion groove 22 into which the coupling protrusion 61 of the rail unit 60 is inserted. Also, the bottom wall 13 includes the coupling groove 23 for being screwed with the fixing part 62 of the rail unit 60. The coupling groove 23 may be disposed on a front side of the insertion groove 22.

The insertion groove 22 may include an opening 22*a* formed on the bottom surface 13*a* to allow the coupling protrusion 61 to be inserted therein, and an inclined portion 22*b* inclined downwardly toward the rear to support the coupling protrusion 61 from a lower side thereof. The insertion groove 22 may include a locking portion 22*c* positioned to restrain an upper surface of the coupling protrusion 61. The inclined portion 22*b* and the locking portion 22*c* may be connected through a rounded portion 22*d*. According to this configuration, the inner case and the rail unit may be coupled through the coupling groove without a separate support member. At the same time, the coupling groove, which has a groove structure rather than a hole structure, may prevent leakage of a foaming liquid when the foamed insulation material is injected into the outside of the inner case.

The coupling groove 23 may include a recess 23*a* recessed downward from the bottom surface 13*a* and a fastening protrusion 23*b* protruding upward from a bottom surface of the recess 23*a*.

The bottom wall 13 may include an embossed part 24 formed by protruding a portion of the bottom surface 13*a* upward so that a receiving space 25 is formed on the back surface 13*b* side of the bottom surface 13*a*. At least a portion of the inclined portion 22*b* and at least a portion of the locking portion 22*c* may be disposed in the receiving space 25. According to this configuration, when a plurality of the inner cases 20 is stacked for storage or transportation, the insertion groove structure formed in one of the inner cases may be prevented from being damaged due to interference with another one of the other inner cases.

Figure 9:
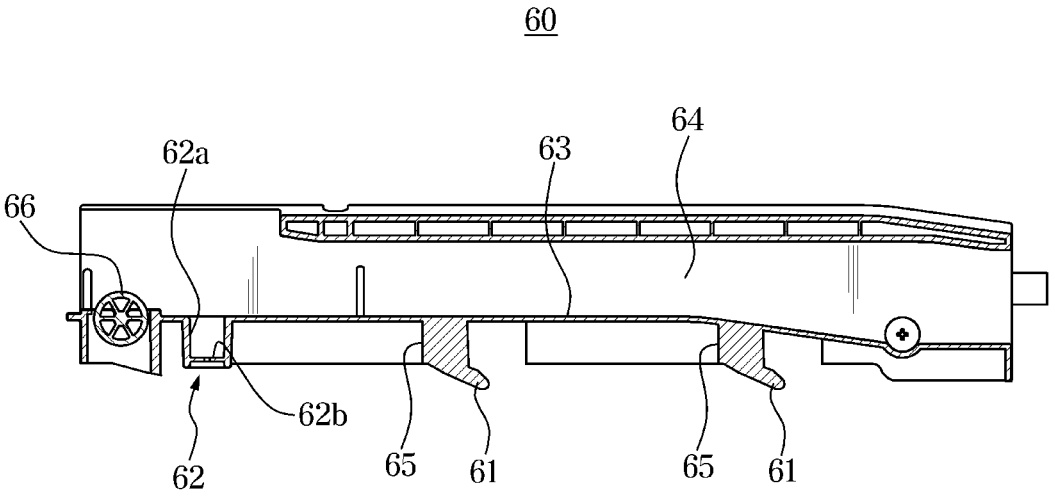
FIG. 9 is a side cross-sectional view of the rail unit in the refrigerator according to an embodiment of the present disclosure.

As illustrated in FIG. 9, the rail unit 60 may include the bottom 63 of the rail unit provided to support the first guide part 52 of the storage container and the guide wall 64 provided to guide the outside of the first guide part 52 (see FIG. 5). The rail unit 60 may include the coupling protrusion 61 formed to be inserted into the insertion groove 22 (see FIG. 8). The rail unit 60 may include the fixing part 62 coupled to the coupling groove 23 (see FIG. 8) to be fixed to the bottom wall 13 (see FIG. 8).

The coupling protrusion 61 is provided to correspond to the insertion groove 22 to be inserted into the insertion groove 22.

The bottom 63 of the rail unit 60 may include a first surface in contact with the first guide part 52 and a second surface opposite to the first surface. The rail unit 60 may include a connection protrusion 65 protruding downward from the second surface of the bottom 63 to be connected to the coupling protrusion 61.

The fixing part 62 may include a side wall 62*a* extending downward from the bottom 63 of the rail unit 60 to form a recessed space, and a bottom 62*b* positioned to face the fastening protrusion 23*b* of the coupling groove 23. An end of the side wall 62*a* may be received in the recess 23*a* of the coupling groove 23 (see FIG. 10). A hole (not shown) is formed on the bottom 62*b* to allow a screw for coupling the fastening protrusion 23*b* (see FIG. 8) to pass therethrough.

Figure 10:
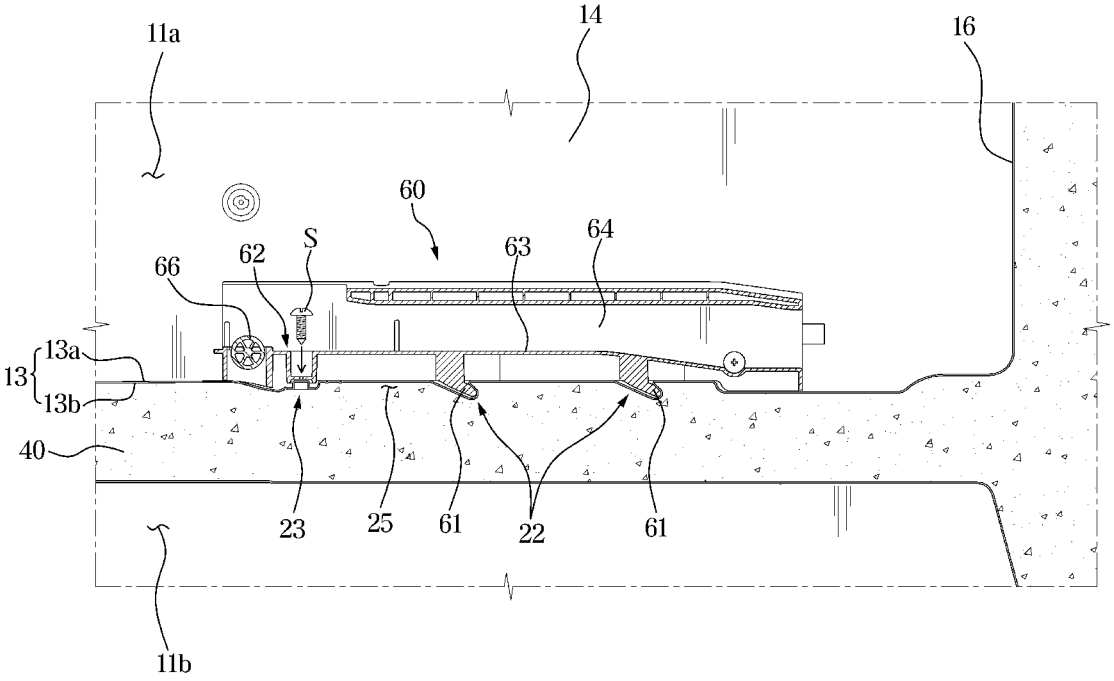
FIG. 10 is a view illustrating a state in which the rail unit of FIG. 9 is coupled to the bottom wall of FIG. 8.

As illustrated in FIG. 10, the coupling protrusion 61 may be inserted into the insertion groove 22, the fixing part 62 may be seated in the coupling groove 23, and a screw S may be inserted into the hole of the fixing part 62. As the screw S is inserted into the hole of the fixing part 62, the fastening protrusion 23*b* of the coupling groove 23 penetrates therethrough. Accordingly, the rail unit 60 may be coupled to the bottom wall 13 of the inner case 20 without installing a separate member for supporting the rail unit 60 in the storage compartment 11*a*. This configuration allows a worker to perform simple and quick assembly. In addition, until the rail unit 60 is coupled, the insertion groove 22 and the coupling groove 23 of the bottom wall 13 are maintained in a state in which no holes exist. That is, leakage of the foaming liquid may be prevented when the insulation material is injected into the outside of the inner case.

However, the structure of the bottom wall 13 and the number and structure of the rail units 60 are only examples, and a plurality of the rail units 60 may be provided.

Figure 11:
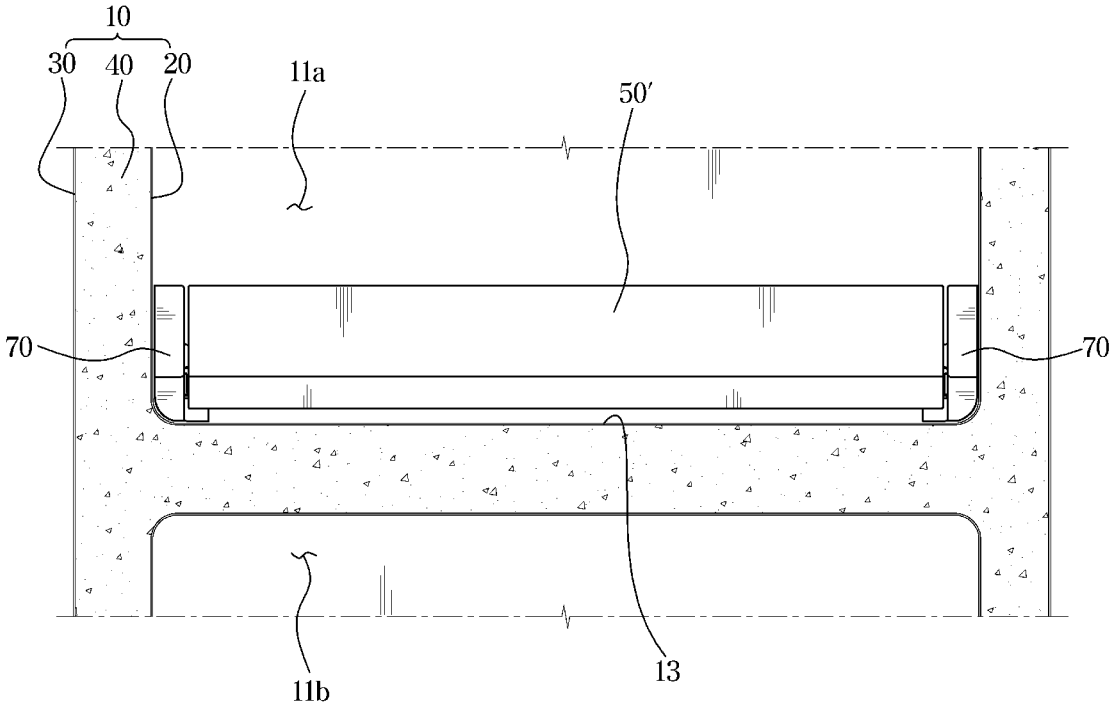
FIG. 11 is an enlarged view of a part of a refrigerator according to another embodiment of the present disclosure.
Figure 12:
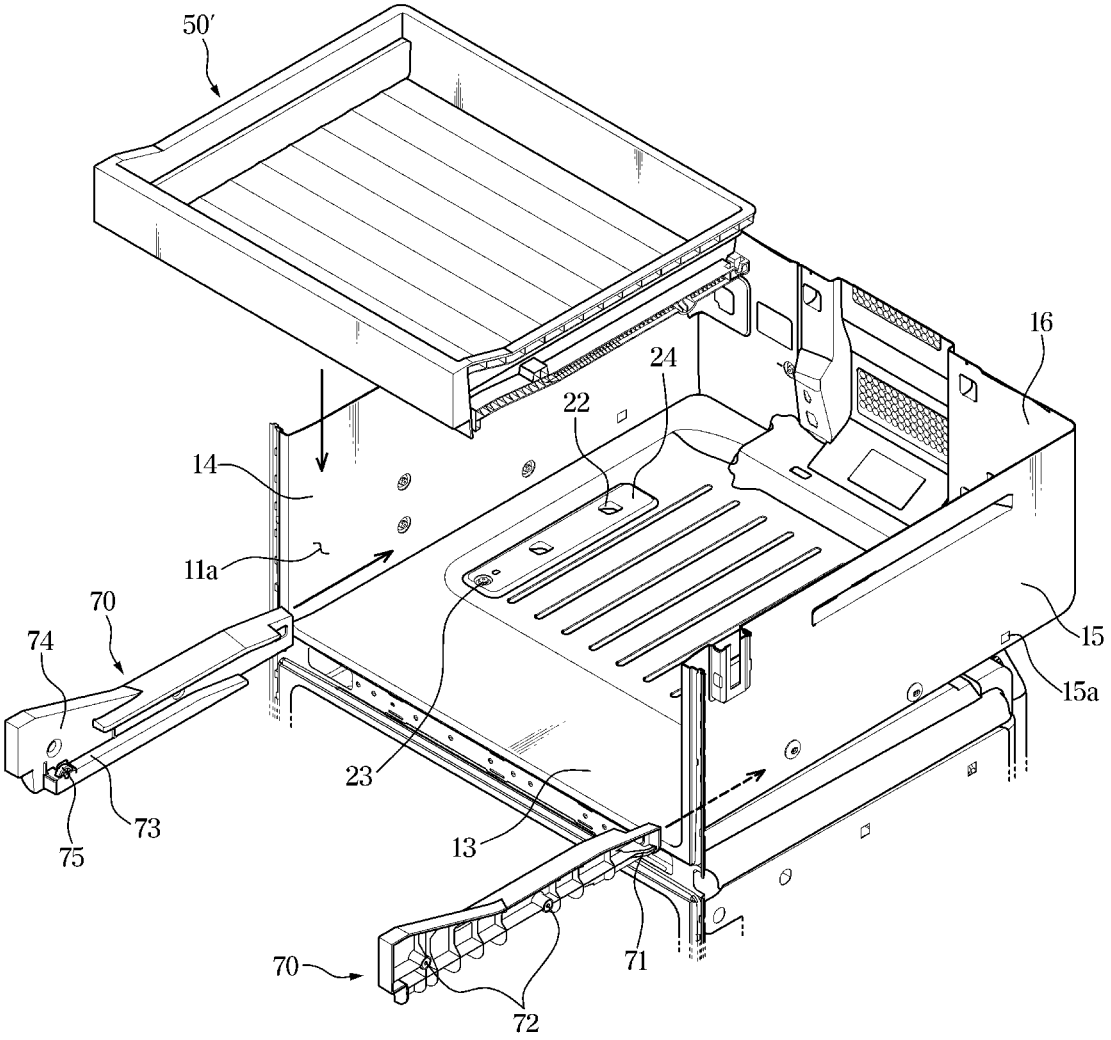
FIG. 12 is a view illustrating that the side rail units and a storage container are separated from an inner case in the refrigerator according to another embodiment of the present disclosure.

A refrigerator according to another embodiment will be described below with reference to FIGS. 11 and 12. Configurations that are the same as those in an embodiment may be assigned the same reference numerals and descriptions thereof may be omitted.

The refrigerator 1 may have two of the side rail units 70. Opposite side surfaces of a storage container 50' may be guided by the side rail units 70.

The bottom wall 13 on which the insertion groove 22 and the coupling groove 23 are formed may have a height protruding toward the refrigerating compartment 11*a*, which is not high. Accordingly, the storage container 50' may be inserted into and withdrawn from the refrigerating compartment 11*a* without interfering with the bottom wall 13. Depending on a choice of a consumer, storage containers of different sizes may be installed in the storage compartment of the refrigerator. Depending on the storage container, the rail unit may be installed on the bottom wall of the inner case as illustrated in FIG. 3, or the side rail units may be installed on the opposite side walls of the inner case as illustrated in FIG. 11. In a case in which different storage containers are installed, an inner case of the same structure may be used in common.

Figure 13:
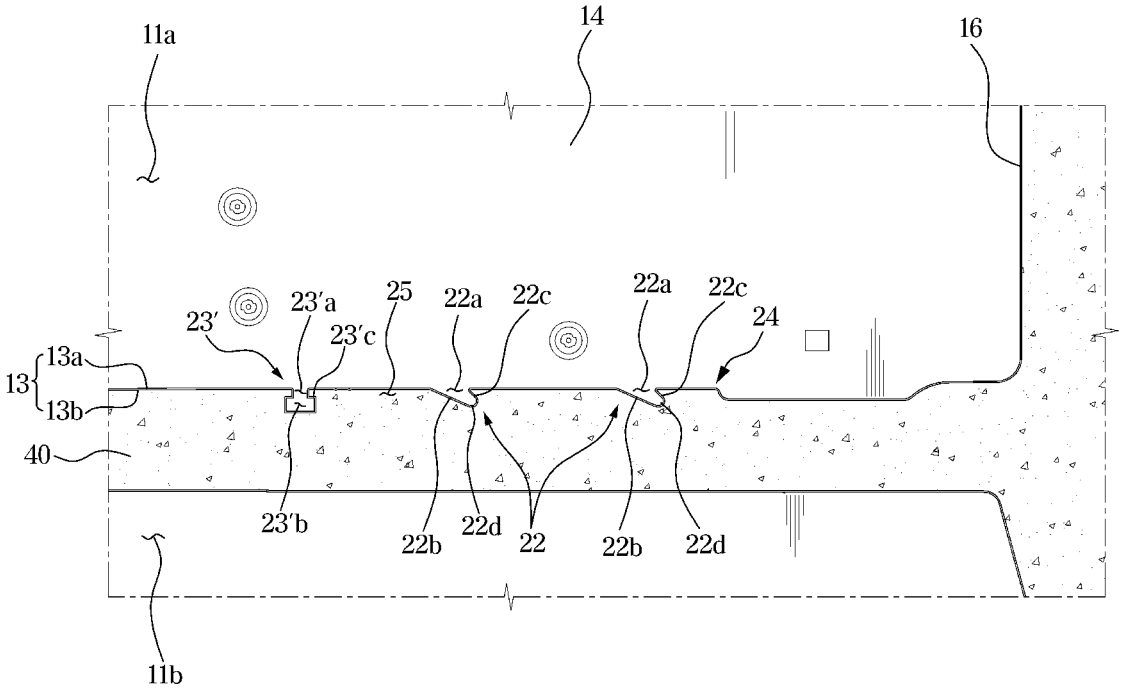
FIG. 13 is a side cross-sectional view of a bottom wall of an inner case in a refrigerator according to another embodiment of the present disclosure.
Figure 14:
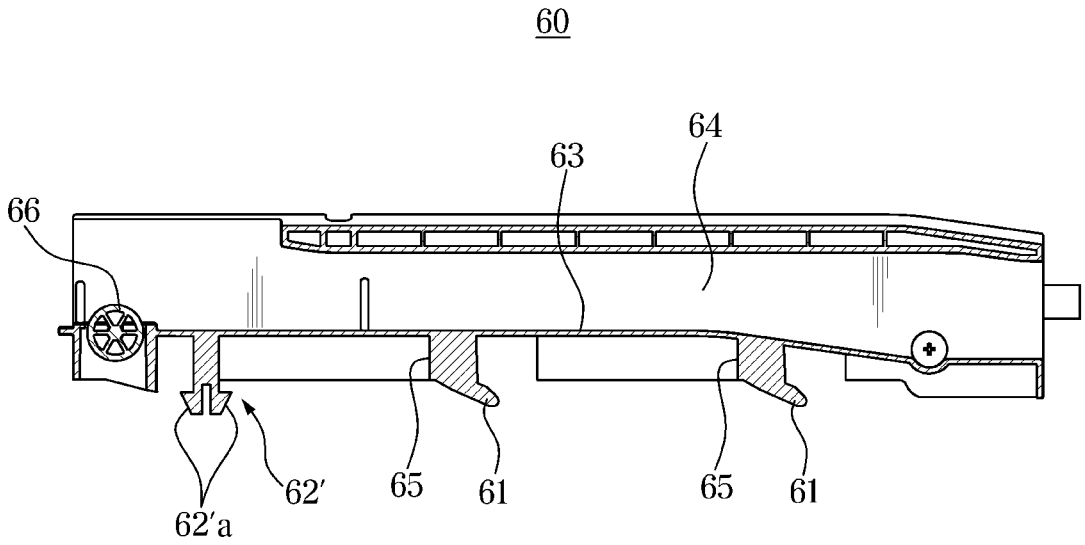
FIG. 14 is a side cross-sectional view of a rail unit of the refrigerator according to another embodiment of the present disclosure.
Figure 15:
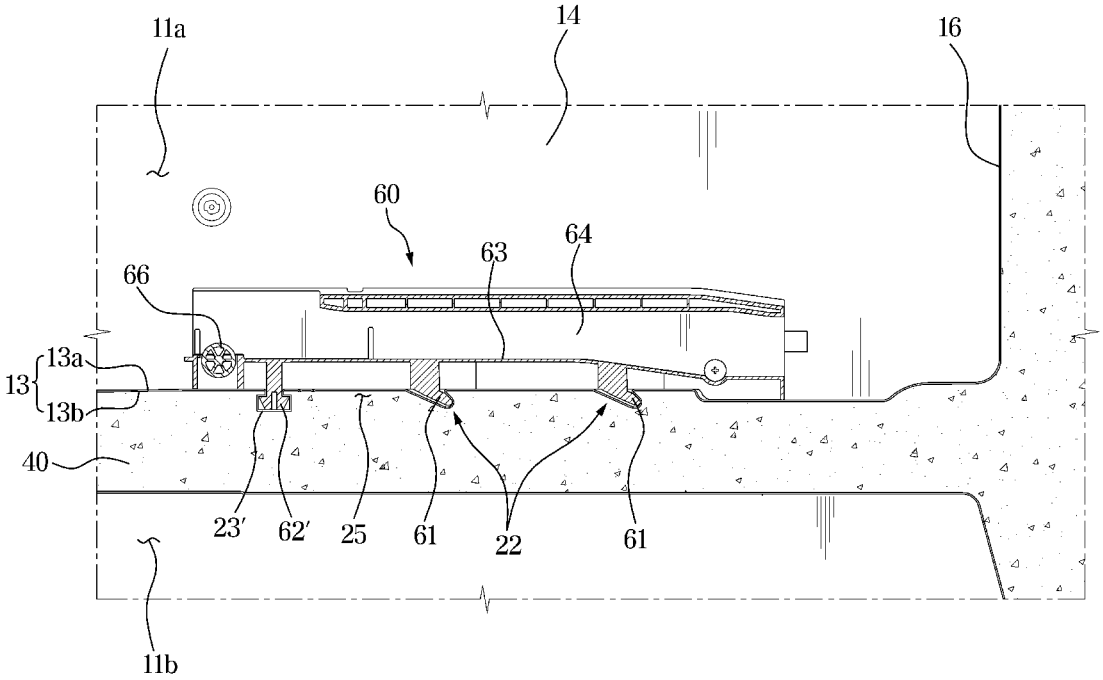
FIG. 15 is a view illustrating a state in which the rail unit of FIG. 14 is coupled to the bottom wall of FIG. 13.

A refrigerator according to another embodiment will be described below with reference to FIGS. 13 to 15. Configurations that are the same as those in an embodiment may be assigned the same reference numerals and descriptions thereof may be omitted.

A coupling groove 23' of the bottom wall 13 may be hook-coupled with a fixing part 62' of the rail unit 60.

The coupling groove 23' may include an opening 23'*a* formed to allow the fixing part 62' to be inserted therein. The coupling groove 23' may include a receiving space 23'*b* provided to receive a protrusions 62'*a* of the rail unit 60 directing to opposite directions. The coupling groove 23' may include locking jaws 23'*c* formed to restrain the protrusions 62'*a* (see FIG. 14) directing to the opposite directions inserted into the opening 23'*a*.

The fixing part 62' of the rail unit 60 may include the protrusions 62'*a* directing to the opposite directions inclined forward and rearward to be inserted into the opening 23'*a*. The protrusions 62'*a* directing to the opposite directions are inserted along the inclined surfaces through the opening 23'*a* to be fixed to the locking jaws 23'*c*.

Figure 16:
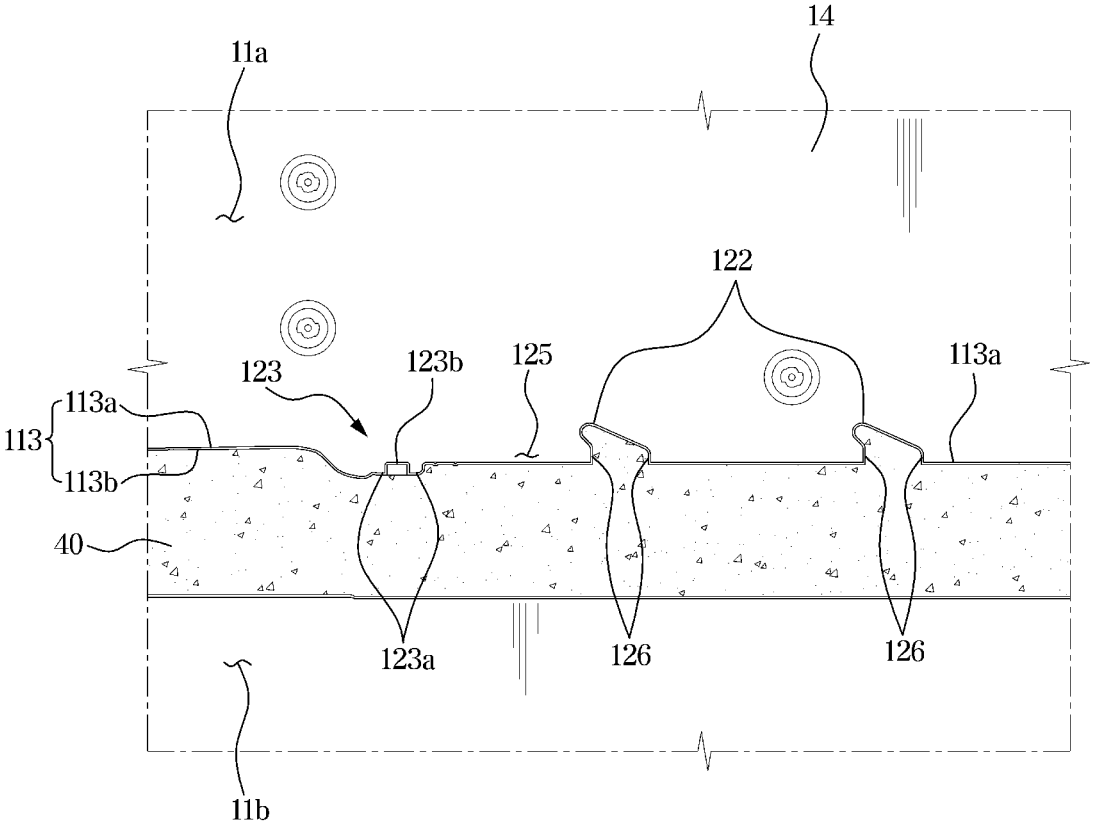
FIG. 16 is an enlarged view of a bottom wall of an inner case in a refrigerator according to another embodiment of the present disclosure.
Figure 17:
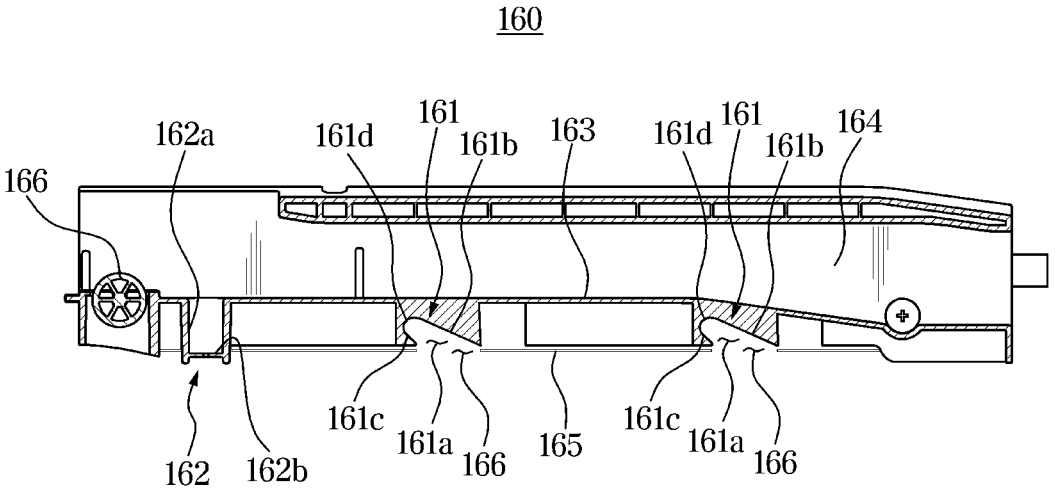
FIG. 17 is a side cross-sectional view of a rail unit of a refrigerator according to another embodiment of the present disclosure.

A refrigerator according to another embodiment will be described below with reference to FIGS. 16 to 18. Configurations that are the same as those in an embodiment may be assigned the same reference numerals and descriptions thereof may be omitted.

The rail unit 160 may include an insertion groove 161 for inserting a coupling protrusion 122 of a bottom wall 113 and a fixing part 162 screwed into a coupling groove 123. The rail unit 160 includes a lower surface 165 facing the bottom wall 113 when installed on the bottom wall 113 of the inner case. An opening 166 may be formed on the lower surface 165 so that the coupling protrusion 122 of the bottom wall 113 may be inserted therein. An area of the opening 166 of the lower surface 165 may be larger than or equal to an area of an opening 161*a* of the insertion groove 161.

The insertion groove 161 may include the opening 161*a* formed to allow the coupling protrusion 122 to be inserted therein, and an inclined portion 161*b* inclined upward toward the front. The insertion groove 161 may include a locking portion 161*c* positioned to support the coupling protrusion 122 from a lower side and restrain the lower surface. The inclined portion 161*b* and the locking portion 161*c* may be connected through a rounded portion 161*d*.

The fixing part 162 may include a side wall 162*a* extending downward from the bottom 163 of the rail unit to form a recessed space, and a bottom 162*b* positioned to face the coupling groove 123, which will be described later. The side wall 162*a* may be received in a recess 123*a* of the coupling groove 123. A hole (not shown) is formed on the bottom 162*b* to allow a screw for being coupled to the coupling groove 123 to pass therethrough.

The bottom wall 113 may include the coupling protrusion 122 provided to be inserted into the insertion groove 161. Also, the bottom wall 113 may include the coupling groove 123 for being screwed with the fixing part 162 of the rail unit 160. The coupling groove 123 may be disposed on a front side of the coupling protrusion 122.

The coupling protrusion 122 may be provided to correspond to the insertion groove 161 to be inserted into the insertion groove 161. The bottom wall 113 may include a connection protrusion 126 protruding upward from a bottom surface 113*a* to be connected to the coupling protrusion 122.

The coupling groove 123 may include the recess 123*a* recessed downward from the bottom surface 113*a*, and a fastening protrusion 123*b* protruding upward from a bottom surface of the recess 123*a*.

The bottom wall 113 may include a recess portion 125 formed by recessing a portion of the bottom surface 113*a* downward to form a receiving space on the bottom surface side. A portion of the coupling protrusion 122 may be disposed at the recess portion 125.

Figure 18:
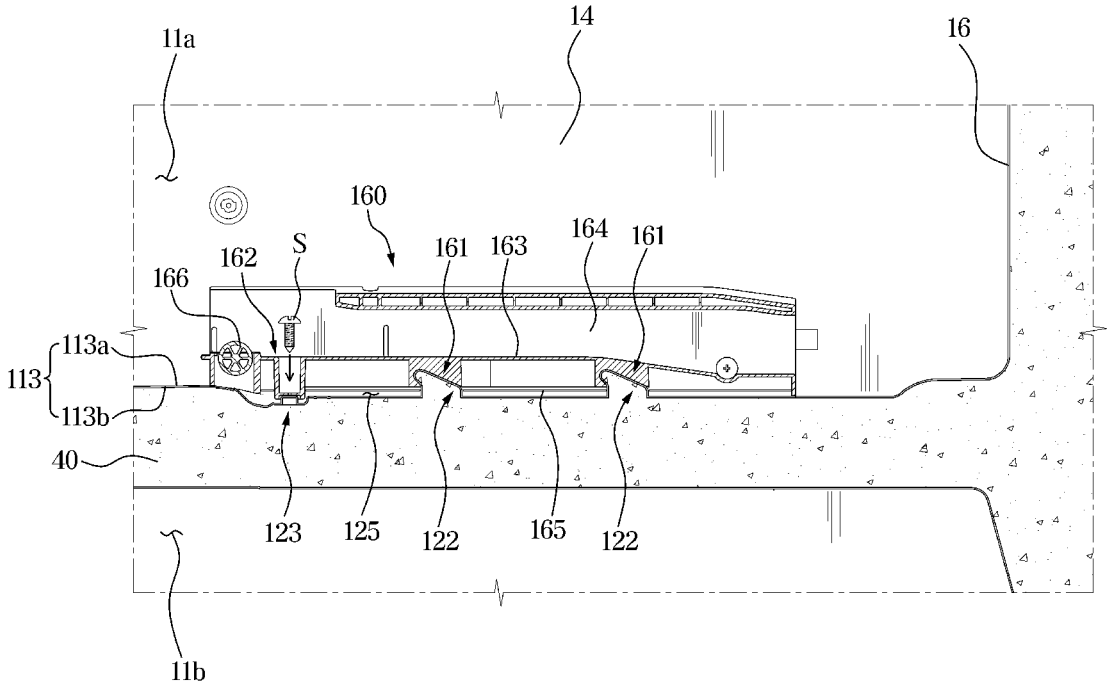
FIG. 18 is a view illustrating a state in which the rail unit of FIG. 17 is coupled to the bottom wall of FIG. 16.

As illustrated in FIG. 18, the coupling protrusion 122 may be inserted into the insertion groove 161, the fixing part 162 may be seated in the coupling groove 123, and the screw S may be inserted into a hole of the fixing part 162. As the screw S is inserted into the hole of the fixing part 162, the fastening protrusion 123*b* of the coupling groove 123 penetrates therethrough.

Figure 19:
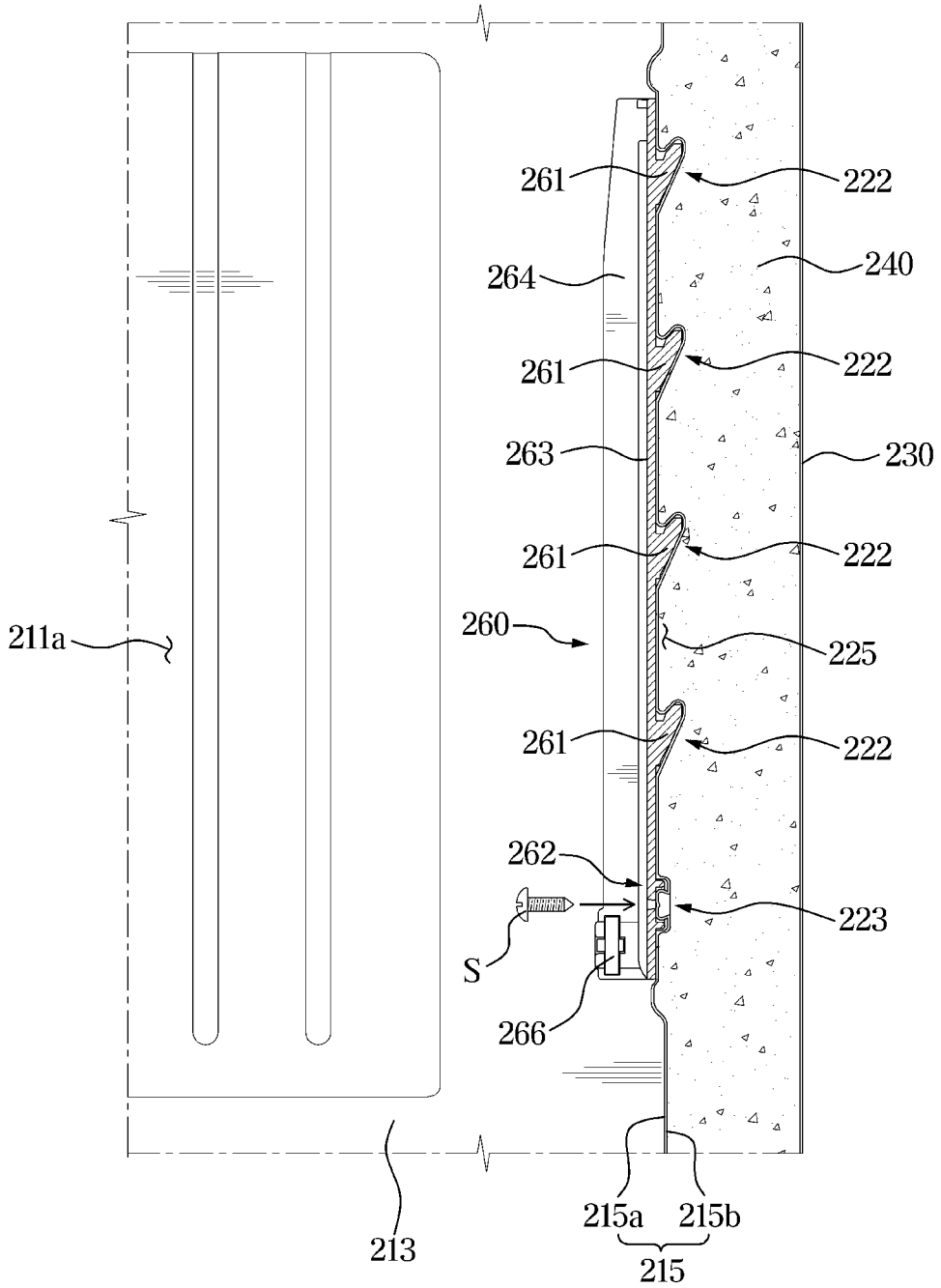
FIG. 19 is a view illustrating a state in which a rail unit is coupled to a side wall of an inner case in a refrigerator according to another embodiment of the present disclosure.

A refrigerator according to another embodiment will be described below with reference to FIG. 19. Descriptions of configurations that are substantially the same as those in an embodiment may be omitted.

A right wall 215 of the inner case 20 may include a bottom surface 215*a* forming the right side of the refrigerating compartment 11*a*, and a back surface 215*b* on the opposite side of the bottom surface 215*a*. The back surface 215*b* of the right wall 215 may be in contact with a foamed insulation material 240.

The right wall 215 may include an insertion groove 222 for inserting a coupling protrusion 261 of a rail unit 260. Also, the right wall 215 includes a coupling groove 223 for being screwed with a fixing part 262 of the rail unit 260. The coupling groove 223 may be disposed on a front side of the insertion groove 222. Other structures may be applied similarly to the first embodiment.

The foregoing has illustrated and described specific embodiments. However, it should be understood by those of skilled in the art that the disclosed embodiments are not limited to the above-described embodiments, and various changes and modifications may be made without departing from the technical idea of the disclosed embodiments described in the following claims.

The invention claimed is:

1. A refrigerator comprising:

an inner case forming a storage compartment therein, the inner case comprising an inner wall surrounding the storage compartment;

an outer case coupled to an outer side of the inner case;

a foamed insulation material disposed between the inner case and the outer case;

a storage container configured to be slidably inserted into and withdrawn from the storage compartment;

a rail unit disposed inside the storage compartment, the rail unit being configured to guide a movement of the storage container, the rail unit comprising a coupling protrusion that is coupled to the inner wall;

an insertion groove formed on the inner wall to allow the coupling protrusion to insert therein; and a coupling groove formed on the inner wall so that the rail unit coupled to the insertion groove fixes to the inner wall, wherein the coupling groove comprises a recess and a fastening protrusion that protrudes upward from a bottom surface of the recess, wherein the coupling groove is disposed on a front side of the insertion groove, wherein the rail unit further comprises a fixing part that corresponds to the coupling groove, the fixing part being fixed to the coupling groove, and wherein the fixing part is screwed into the coupling groove.

2. The refrigerator according to claim 1, wherein the inner wall of the inner case comprises a bottom wall forming a bottom of the storage compartment, and wherein the insertion groove is formed on the bottom wall so that the coupling protrusion inserts into the insertion groove in a front to rear direction.

3. The refrigerator according to claim 1, wherein the inner wall of the inner case comprises opposite side walls disposed on opposite sides of the storage compartment, and wherein the insertion groove is formed on each of the side walls so that the coupling protrusion inserts into the insertion groove in a front to rear direction.

4. The refrigerator according to claim 2, wherein the bottom wall comprises:

a bottom surface forming the bottom of the storage compartment, and a back surface that is opposite to the bottom surface of the bottom wall, and wherein the insertion groove comprises:

an opening formed on the bottom surface of the bottom wall to allow the coupling protrusion to insert therein, an inclined portion inclined downward from the bottom surface of the bottom wall toward a rear of the insertion groove to support the coupling protrusion, and a locking portion positioned to restrain an upper surface of the coupling protrusion to connect to the inclined portion.

5. The refrigerator according to claim 4, wherein the insertion groove further comprises a rounded portion connecting the inclined portion and the locking portion.

6. The refrigerator according to claim 4, wherein the bottom wall further comprises an embossed portion that protrudes upward from the bottom surface of the bottom wall so that a receiving space is formed on the back surface, and wherein at least a portion of the inclined portion and at least a portion of the coupling portion are disposed in the receiving space.

7. The refrigerator according to claim 1, wherein the rail unit further comprises a rail bottom configured to support a guide part of the storage container, and wherein the fixing part comprises:

a side wall extending downward from the rail bottom to form a recessed space and having a lower end that inserts in the recess, and a bottom positioned to face the fastening protrusion, the bottom having a hole to allow a screw to pass therethrough.

8. The refrigerator according to claim 7, wherein the rail unit further comprises a connection protrusion that protrudes downward from the rail bottom and is configured to be connected to the coupling protrusion.

9. The refrigerator according to claim 7, wherein the rail unit further comprises a guide wall extending upward from the bottom rail, the guide wall being configured to guide the outside of the guide part of the storage container, and wherein a water tank unit is disposed between the guide wall and one side wall of the inner case.

10. The refrigerator according to claim 9, wherein the water tank unit comprises:

a casing that is fixed to the guide wall, and a water tank that is accommodated inside the casing.

11. A refrigerator comprising:

an inner case forming a storage compartment therein, the inner case comprising an inner wall surrounding the storage compartment;

an outer case coupled to an outer side of the inner case;

a foamed insulation material disposed between the inner case and the outer case;

a storage container configured to be slidably inserted into and withdrawn from the storage compartment;

a rail unit disposed inside the storage compartment;

a coupling protrusion provided on one of the inner wall or the rail unit;

an insertion groove formed on an other of the inner wall or the rail unit so that the coupling protrusion inserts therein; and a coupling groove formed on the inner wall so that the rail unit is fixed to the inner wall, wherein the coupling groove comprises a recess and a fastening protrusion that protrudes upward from a bottom surface of the recess, wherein the coupling groove is disposed on a front side of the insertion groove, wherein the rail unit comprises a fixing part that corresponds to the coupling groove, the fixing part being fixed to the coupling groove, and wherein the fixing part is screwed into the coupling groove.

12. The refrigerator according to claim 11, wherein the inner wall of the inner case comprises a bottom wall forming a bottom of the storage compartment, wherein the bottom wall comprises:

a bottom surface forming the bottom of the storage compartment, and an embossed portion that protrudes upward from the bottom surface of the bottom wall, wherein the coupling protrusion is disposed on the rail unit, wherein the insertion groove is disposed on the embossed portion, and wherein the insertion groove comprises:

an opening formed on the bottom surface of the bottom wall so that the coupling protrusion inserts therein, an inclined portion inclined downward from the bottom surface of the bottom wall toward a rear of the insertion groove, and a locking portion positioned to restrain the coupling protrusion to connect to the inclined portion.

13. The refrigerator according to claim 11, wherein the inner wall of the inner case comprises a bottom wall forming a bottom of the storage compartment, wherein the bottom wall comprises:

a bottom surface forming the bottom of the storage compartment, and a recessed portion that recesses downward from the bottom surface of the bottom wall, wherein the coupling protrusion is disposed on the recessed portion, and wherein the insertion groove is disposed on the rail unit.

14. The refrigerator according to claim 11, wherein the inner wall of the inner case comprises opposite side walls disposed on opposite sides of the storage compartment, wherein the side walls of the inner case comprise:

side surfaces forming opposite sides of the storage compartment, and embossed portions that protrude from the side surfaces toward the storage compartment, wherein the coupling protrusion is disposed on the rail unit, wherein the insertion groove is disposed on the embossed portion, and wherein the insertion groove comprises:

an opening formed on the side surface to allow the coupling protrusion to insert therein, an inclined portion inclined rearward from the side surface toward a rear of the insertion groove, and a locking portion positioned to restrain the coupling protrusion to connect to the inclined portion.

* * * * *